US010502049B2

(12) United States Patent
McEwen-King et al.

(10) Patent No.: US 10,502,049 B2
(45) Date of Patent: Dec. 10, 2019

(54) FRACTURE CHARACTERISATION

(71) Applicant: OPTASENSE HOLDINGS LIMITED, Hampshire (GB)

(72) Inventors: Magnus McEwen-King, Dorchester (GB); David John Hill, Farnborough (GB); Menno Mathieu Molenaar, The Hague (NL)

(73) Assignee: Optasense Holdings Limited (GB)

( * ) Notice: Subject to any disclaimer, the term of this patent is extended or adjusted under 35 U.S.C. 154(b) by 79 days.

(21) Appl. No.: 15/234,672

(22) Filed: Aug. 11, 2016

(65) Prior Publication Data

US 2016/0348497 A1 Dec. 1, 2016

Related U.S. Application Data

(63) Continuation of application No. 13/988,839, filed as application No. PCT/GB2011/001666 on Nov. 30, 2011, now Pat. No. 9,416,644.

(30) Foreign Application Priority Data

Dec. 1, 2010 (GB) ..... 1020358.6

(51) Int. Cl.
*E21B 43/26* (2006.01)
*E21B 47/10* (2012.01)
(Continued)

(52) U.S. Cl.
CPC ..... *E21B 47/101* (2013.01); *E21B 43/26* (2013.01); *E21B 43/267* (2013.01); *E21B 47/123* (2013.01); *E21B 49/00* (2013.01)

(58) Field of Classification Search
CPC ..... E21B 43/26; E21B 47/00
See application file for complete search history.

(56) References Cited

U.S. PATENT DOCUMENTS 4,718,493 A 1/1988 Hill et al.
5,050,674 A 9/1991 Soliman et al.
(Continued)

FOREIGN PATENT DOCUMENTS

GB 2442745 4/2008
WO WO 98/50680 11/1998
(Continued)

OTHER PUBLICATIONS

F.X. Bostick: "Commercialization of Fiber Optic Sensors for Reservoir Monitoring", Offshore Technology Conference, OTC 15320, May 5, 2003 (May 5, 2003), pp. 1-11.
(Continued)

*Primary Examiner* — William D Hutton, Jr.
*Assistant Examiner* — Steven A Macdonald
(74) *Attorney, Agent, or Firm* — McDonnell Boehnen Hulbert & Berghoff LLP

(57) ABSTRACT

This application relates to methods and apparatus for monitoring hydraulic fracturing in well formation and fracture characterization using distributed acoustic sensing (DAS). The method involves interrogating an optic fiber arranged down the path of a borehole to provide a distributed acoustic sensor and also monitoring flow properties of fracturing liquid pumped into the well where the acoustic data from the distributed acoustic sensor is processed together with the flow properties data to provide an indication of at least one fracture characteristic.

17 Claims, 4 Drawing Sheets

(51) Int. Cl.

| | |
|---|---|
| ***E21B 47/12*** | (2012.01) |
| ***E21B 43/267*** | (2006.01) |
| ***E21B 49/00*** | (2006.01) |

(56) References Cited

U.S. PATENT DOCUMENTS

| | | | | |
|---|---|---|---|---|
| 5,662,165 | A * | 9/1997 | Tubel | E21B 23/03 166/113 |
| 2002/0063866 | A1* | 5/2002 | Kersey | E21B 47/102 356/478 |
| 2002/0064331 | A1* | 5/2002 | Davis | E21B 47/102 385/12 |
| 2002/0109080 | A1* | 8/2002 | Tubel | E21B 23/03 250/227.14 |
| 2007/0272407 | A1 | 11/2007 | Lehman et al. | |
| 2008/0041594 | A1* | 2/2008 | Boles | E21B 43/26 166/305.1 |
| 2008/0156484 | A1* | 7/2008 | Mese | E21B 43/26 166/250.1 |
| 2008/0210427 | A1* | 9/2008 | Ziauddin | E21B 43/114 166/307 |
| 2009/0114386 | A1 | 5/2009 | Hartog et al. | |
| 2010/0032156 | A1 | 2/2010 | Petty et al. | |
| 2010/0207019 | A1 | 8/2010 | Hartog et al. | |
| 2011/0209868 | A1* | 9/2011 | Dusterhoft | E21B 43/114 166/250.1 |
| 2014/0182844 | A1 | 7/2014 | Wutherich et al. | |

FOREIGN PATENT DOCUMENTS

| | | |
|---|---|---|
| WO | WO 2005/033465 | 4/2005 |
| WO | WO 2010/136764 | 12/2010 |

OTHER PUBLICATIONS

N.R. Warpinski: "Integrating Microseismic monitoring With Well Completions, Reservoir Behaviour, and Rock Mechanics", Society of Petroleum Engineers, SPE125239, Jun. 15, 2009 (Jun. 15, 2009), pp. 1-12.

* cited by examiner

Flow rate
401
402
409
$t_1$
$t_2$
t

Channel
201
202
203
403
404
405
$t_1$
$t_2$
t

Relative Flow
406
407
408
t

FRACTURE CHARACTERISATION

This application claims priority to U.S. application Ser. No. 13/988,839 filed on May 22, 2013 which is a 371 application of PCT/GB2011/001666 filed on Nov. 30, 2011 which claims priority to Great Britain patent application serial no. 1020358.6 filed on Dec. 1, 2010 the specifications of each of which are incorporated by reference herein.

FIELD OF THE INVENTION

The present invention relates to the monitoring and characterisation of fracturing performed during the formation of production wells such as oil and gas wells. In particular, the present invention relates to characterisation of fracturing using downhole distributed acoustic sensing (DAS) monitoring.

BACKGROUND OF THE INVENTION

Fracturing is an important process during the formation of some oil or gas wells, referred to as unconventional wells, to stimulate the flow of oil or gas from a rock formation. Typically a borehole is drilled to the rock formation and lined with a casing. The outside of the casing may be filled with cement so as to prevent contamination of aquifers etc. when flow starts. In unconventional wells the rock formation may require fracturing in order to stimulate the flow. Typically this is achieved by a two-stage process of perforation followed by hydraulic fracturing. Perforation involve firing a series of perforation charges, i.e. shaped charges, from within the casing that create perforations through the casing and cement that extend into the rock formation. Once perforation is complete the rock is fractured by pumping a fluid, such as water, down the well under high pressure. This fluid is therefore forced into the perforations and, when sufficient pressure is reached, causes fracturing of the rock. A solid particulate, such as sand, is typically added to the fluid to lodge in the fractures that are formed and keep them open. Such a solid particulate is referred to as proppant. The well may be perforated in a series of sections, starting with the furthest section of well from the well head. Thus when a section of well has been perforated it may be blocked off by a blanking plug whilst the next section of well is perforated and fractured.

The fracturing process is a key step in unconventional well formation and it is the fracturing process that effectively determines how efficient that well is going to be. However control and monitoring of the fracture process is very difficult. The amount of fluid and proppant and flow rate are generally measured to help determine when sufficient fracturing may have occurred and also to identify potential problems in the fracturing process.

One possible problem, known as proppant wash-out, occurs when the cement surrounding the casing has failed and the fluid is simply flowing into a void. This wastes proppant fluid and prevents effective fracturing. A high flow rate or sudden increase in flow rate may be indicative of proppant wash-out.

Another problem relates to a situation that can develop where most of the fluid and proppant flows to the rock formation via one or more perforations, preventing effective fracturing via other perforation sites. Typically a fracturing process is performed for a segment of the well and, as mentioned above, several perforations may be made along the length of that well section such that the subsequent hydraulic fracturing process causes fracturing at a number of different locations along that section of well. During the hydraulic fracturing process however it is possible that the rock at one or more perforation sites may fracture more readily than at the remaining perforations. In this case one or more of the developing fractures may start to take the majority of the fluid and proppant, reducing the pressure at the other perforation sites. This can result in reduced fracturing at the other perforation sites. Increasing the flow rate of fluid and proppant may simply lead to increased fracturing at the first peroration site which may ultimately just enlarge the fracture and not have a significant impact on how much oil or gas is received via that fracture. However reduced fracturing at the other sites can reduce the amount of oil and gas received via those sites, thus negatively impacting on the efficiency of the well as a whole. For example suppose that a section of well is perforated at four different locations for subsequent fracturing. If during the fracturing process three of the perforation sites fracture relatively readily then more of the fluid and proppant will flow to these sites. This may prevent the fourth fracture site from ever developing sufficient pressure to effectively fracture with the result that only three fractures extend into the rock formation to provide a path for flow. Thus the efficiency of this section of the well is only 75% of what would be ideally expected.

If such a situation is suspected additional, larger solid material can be added to the fluid, typically balls of solid material of a particular size or range of sizes. The size of the balls is such that they can flow into relatively large fractures where they will be embedded to cause an obstruction but are large enough not to interfere with relatively small fractures. In this way relatively large fractures, which may be consuming most of the fracture fluid, are partially blocked during the hydraulic fracture process, with the result that the flow to all fractures is evened out.

Conventionally the flow conditions of the fracture fluid is monitored to try to determine if one or more fracture sites are becoming dominant and thus preventing effective fracturing at one or more other fracture sites but this is difficult to do and often relies on the experience of the well engineers.

As well as the problems noted above merely controlling the fracture process to ensure that a desired extent of fracturing has occurred is difficult. Further, there may be more than one oil well provided to extract the oil or gas from the rock formation. When creating a new well the factures should not extend into an area of the rock formation which is already supplying an existing well as any flow at the new well from such area may simply reduce the flow at the existing well. Determining the direction and extent of the fractures is very difficult however.

In addition to monitoring the flow rate of the fluid, sensor readings may be acquired during the fracturing process from sensors located in a separate observation well and/or at ground level. These sensors may include geophones or other seismic sensors deployed to record seismic event during the fracture process. These sensor readings can then be analysed after the fracturing process in order to try to determine the general location and extent of fracturing but offer little use for real time control of the fracturing process.

SUMMARY OF THE INVENTION

It is an object of the present invention to provide improved systems and methods for monitoring and characterisation of downhole fracturing.

According to a first aspect of the invention there is provided a method of fracture characterisation of a downwell hydraulic fracturing process comprising: interrogating a optic fibre arranged down the path of a bore hole to provide a distributed acoustic sensor; monitoring flow properties of fracturing fluid; and processing acoustic data from the distributed acoustic sensor together with the flow properties data to provide an indication of at least one fracture characteristic.

The method of the present invention thus uses fibre optic distributed acoustic sensing to provide acoustic data associated with the fracturing process and processes this acoustic data together with data relating to the flow properties of the fracturing fluid in order to provide fracture characterisation.

Distributed acoustic sensing (DAS) is a known sensing technique wherein a single length of longitudinal optic fibre is optically interrogated, usually by one or more input pulses, to provide substantially continuous sensing of vibrational activity along its length. Optical pulses are launched into the fibre and the radiation backscattered from within the fibre is detected and analysed. By analysing the radiation backscattered within the fibre, the fibre can effectively be divided into a plurality of discrete sensing portions which may be (but do not have to be) contiguous. Advantageously the detected backscattered radiation may be radiation which has undergone Rayleigh scattering bur DAS systems using Brillouin or Raman scattering, or a combination of different types of scattering, may be used. Within each discrete sensing portion mechanical vibrations of the fibre, for instance from acoustic sources, cause a variation in the characteristics of radiation which is backscattered from that portion. This variation can be detected and analysed and used to give a measure of the intensity of disturbance of the fibre at that sensing portion. As used in this specification the term "distributed acoustic sensor" will be taken to mean a sensor comprising an optic fibre which is interrogated optically to provide a plurality of discrete acoustic sensing portions distributed longitudinally along the fibre and acoustic shall be taken to mean any type of mechanical vibration or pressure wave, including seismic waves. The method may therefore comprise launching a series of optical pulses into said fibre and detecting radiation Rayleigh backscattered by the fibre; and processing the detected Rayleigh backscattered radiation to provide a plurality of discrete longitudinal sensing portions of the fibre. Note that as used herein the term optical is not restricted to the visible spectrum and optical radiation includes infrared radiation and ultraviolet radiation.

The optic fibre is preferably located within the well bore in which fracturing is being performed, i.e. the borehole in which the fibre is located is the well bore itself. In one arrangement the optic fibre runs along the exterior of the well casing, although the fibre could, in some embodiments, be arranged to run within the casing. The optic fibre may be attached to the well casing as it is being inserted into the well bore and, if on the exterior of the casing, subsequently cemented in place in those sections of the well which are cemented. It will be appreciated that the conditions down a deep well bore can be hostile and especially so during hydraulic fracturing. Therefore placement of a specific sensor down the well bore during fracturing has not hitherto been practical. The method of the present invention uses a fibre optic which may to be located on the exterior of the well casing to provide a downhole sensor in the well bore being fractured.

The fibre therefore follows the general route of the well bore and extends at least as far into the well bore as the region in which fracturing is to occur. When fracturing any given section of the well bore, the fibre can therefore be interrogated to provide one, or preferably a plurality, of acoustic sensing portions in the vicinity of the fracturing site, i.e. the location along the well bore at which fracture fluid is flowing, or is expected to flow, into the rock formation to cause fracturing. The sensing portions of interest should generally be known from a knowledge of the length along the fibre, and hence the well. However, when perforation is performed the method may comprise monitoring the acoustic disturbances in the fibre generated by the perforation step. The acoustic disturbances during perforation may be used to determine the portions of the fibre that correspond to fracture sites. For instance, portions of the fibre which exhibit the greatest acoustic disturbance intensity during perforation will generally correspond to the location where the perforation charges fired and hence to the fracture sites.

The acoustic data from the DAS sensor thus comprises the acoustic signals detected by a plurality of sensing portions of the fibre in the vicinity of the downwell fracturing sites. This acoustic data thus indicates what is actually happening in different locations downwell. In the method of the present invention this acoustic data is processed along with the data regarding the flow properties of the fracture fluid to determine fracture characteristics.

In one embodiment the flow data may be correlated with the acoustic data. The correlation may comprise correlating any acoustic disturbances, or changes in the acoustic signals detected with a change in flow properties, such as flow rate or pressure of the fracturing fluid. For instance if the pressure of the fracture fluid drops or the flow rate increases just after a significant acoustic disturbance is detected in the vicinity of a fracturing site this can be taken as an indication that significant fracturing has occurred at that fracturing site. Whilst the acoustic data itself is indicative of the fracturing it will be appreciated that the fracturing process may be very noisy and correlating with the flow data may improve the identification of significant fracturing events.

Correlating the flow data and acoustic data may also help to identify proppant wash out. If an acoustic event is detected at a section of the well bore which is not a fracture site and the flow rate of fracture fluid suddenly increases or the pressure of the fluid suddenly drops, this could indicate failure of the well casing or cement bond at the relevant section of the well resulting in proppant wash-out.

In a DAS sensor such as described in GB2442745, the processing from each separate acoustic channel can be done in real time. Thus the correlation of the acoustic events with changes in the flow properties can also be done in real time and the method may be used as part of a monitoring process that may be used to control the hydraulic fracturing.

In one embodiment of the method the fracturing characteristic is the amount of fracturing fluid/proppant supplied to an individual fracture site and the method comprises determining the amount of fracture fluid and/or proppant supplied to each fracture site.

In general the acoustic data may be used to determine the relative flow rates of the fracture fluid/proppant to the individual fracture sites. By looking at the rate of flow of fracture fluid into the well the amount of fluid flowing into each fracture may therefore be determined. By also looking at the rate of proppant flow, which may for instance be determined using the rate of fluid flow and the concentration of proppant, or rate of addition of proppant to the fluid, the actual amount of proppant supplied to each fracture site can be determined.

The ability to determine the amount of proppant supplied to each fracture site individually is a novel aspect of the present invention that has not hitherto been possible.

Determining the amount of proppant supplied to each individual fracture site may be used as part of the control of the hydraulic fracturing process. For instance the amount of proppant supplied to each fracture may be used as measure of the degree or the extent of fracturing at a particular site. In particular the amount of proppant supplied may be used as an indication of how far fracturing has extended. As described above there may be more than one well provided to extract the oil or gas from the rock. It is therefore desired to control the extent of fracturing from each well bore so that fractures from one well bore do not extend to a part of the reservoir accessed by another well. To do so would simply reduce flow from the other well and thus reduce overall efficiency. Therefore there is a desire to control the fracturing process, for instance by stopping the process at an appropriate point, such that fracturing extends no more than a certain distance from the well bore. This can be difficult to monitor and control in practice however.

The amount of proppant delivered to each fracture may be related to the distance that the relevant fracture extends and hence by monitoring the cumulative amount of proppant delivered to each fracture the extent of that fracture may be estimated. Thus fracturing may be stopped once a certain amount of proppant has been delivered to the fracture site, or, if one fracture site is dominant, additives such as balls may be added to the flow to reduce the amount of proppant flowing to such a fracture site.

Additionally or alternatively it may be desired to a predetermined amount of proppant to each fracture site. It may be that for a particular type of rock conditions that it is known that delivering a certain amount of proppant to a fracture usually results in good production performance, i.e. a good rate of inflow of oil or gas in the production phase. Thus it may be desired to ensure that a certain amount of proppant is delivered to a fracture site.

Data collected during the fracturing process, can be used to provide useful real-time feedback, but may additionally or alternatively be retained for further analysis. For example the acoustic data may be collected during the fracturing process and then afterwards analysed together with the flow data, for example to determine the amount of proppant delivered to each fracture site. The data collected may also be correlated with subsequent production in order to identify characteristics of the transients which may be associated with good production.

It should be noted that the DAS sensor employed downhole may, after fracturing, also be employed as an in-flow monitoring system during actual production from the well. In this way the flow of oil/gas into the well may be monitored and the relative flow from each different fracturing site may be assessed. Measuring the overall flow at the top of the well is indicative of the overall fracturing process for the whole well. By using the DAS sensor however the relative contribution from each fracturing site or collection of sites may be assessed.

It may therefore be possible to correlate the amount of proppant delivered, for each fracture site (in a particular type of rock formation) with subsequent production capability. Thus a preferred amount of proppant for a particular rock formation, and the characteristics associated with the fracturing may be identified.

In this way it may be possible to control subsequent fracturing processes to deliver an amount of proppant to a fracture site which lies in a preferred range.

Many oil/gas wells are located in remote locations. Transporting the amount of proppant required for fracturing is a significant cost. If the amount of proppant required can be significantly reduced, with no loss in production of the resulting well, this could represent a significant saving. The method of the present invention may provide an indication of the optimal amount of proppant required and may also allow a process operator to ensure that the correct amount of proppant is delivered to each fracture site.

The method may therefore comprise analysing the acoustic data to determine the relative flow rates of fracture fluid/proppant to each of a plurality of downwell fracture sites. The processing of the acoustic data may comprise a comparison of the intensity levels of acoustic disturbances in the vicinity of each of a number of different fracture sites. The average intensity or acoustic energy in each relevant sensing portion of fibre can be used to indicate if one fracture site is performing significantly differently to another fracture site, e.g. whether one fracture site is associated with a significantly lower or higher acoustic energy than another fracture site. This can be used to indicate the relative flows of fracture fluid to the fracture sites.

If an acoustic channel of the fibre in the vicinity of one fracture site is showing a significantly higher acoustic energy than the other fracture sites this could be a sign that a greater proportion of the proppant fluid is flowing into the rock formation at this point. Similarly if one fracture site is showing a relatively low acoustic intensity this could be an indication that there is no significant flow of proppant fluid into the rock formation. Thus the relative acoustic intensities could be used to indicate that one or more fracture sites is consuming more of the proppant fluid and/or one or more of the fracture sites are relatively inactive.

The method may involve dividing the data from the longitudinal sensing portions of the fibre into one or more spectral bands. In other words the data may be filtered so as to include only acoustic disturbances with a frequency within the frequency range of the particular spectral band. Analysing the data by spectral band can more clearly indicate the acoustic difference between various channels at the fracture sites. As the proppant fluid flow is a high pressure flow of a fluid containing a particulate it is inherently a noisy process and there will be a variety of acoustic responses due to the flow within the casing. Flow into a perforation may be associated with a particular frequency characteristic and thus the difference between the flows may more readily discernible at a particular spectral band or bands.

As mentioned above the hydraulic fracturing step is inherently a very noisy process. Thus the use of an acoustic sensor, within the well bore in which fracturing is occurring, to provide meaningful information regarding the fracturing occurring is surprising.

In some cases the spectral band of most interest may be known in advance. In other cases however the well dynamics and dynamics of the fracturing process may all influence the spectral response. Therefore in some embodiments the method may comprise dividing the acoustic disturbances from the relevant sensing portions of the fibre into a plurality of spectral bands.

The spectral bands may be processed to automatically detect a spectral band of interest. For instance the data for each spectral band may be processed to detect the presence of significant local maxima of average energy which could be indicative of the acoustic signal from the proppant and fluid flowing into the perforation site. The processing could be constrained based on knowledge of the acoustic channels that correspond to the perforation sites, for instance as predetermined based on knowledge of the fibre, as selected by an operator or as determined by measurement during firing of the perforation charges. In other words the spectral bands could be analysed to determine a spectral band in which the energy in the channels corresponding to the perforation sites are significantly higher than the energy of other nearby channels. The spectral bands could also be analysed to detect the relative acoustic energies in spectral bands of interest at one or more channels corresponding to the perforation sites. In other words analyzing the spectral bands may be used to determine relative flow rates into the various fracture sites.

The method may also comprise monitoring the relative acoustic energy of the channels corresponding to the perforation sites over time, for instance to determine if the instantaneous average in any relevant channel is changing significantly and/or if the relative energies in the channels corresponding to the perforation sites varies.

In some embodiments the frequency and/or intensity signals from the channels which are located at the perforation sites may be analysed to determine characteristics of the fracture. As mentioned above the mechanical disturbances experienced by the acoustic channels due to flow of the fracture fluid into the rock formation via the perforation site may comprise frequency components that may be dependent on the relative size of the perforation and current fracture size. Thus by analysing the frequency or frequencies at which the acoustic signals due predominantly to flow of fluid into the fracture the relative flow into the fracture may be inferred.

As mentioned previously whilst the method can be used to provide real-time monitoring of the fracturing processes in some instances the data may be collected during fracturing but only analysed later. Thus in another aspect of the invention a method of fracture characterisation comprises: taking acoustic data acquired from a downwell fibre optic distributed acoustic sensor during a fracturing process, taking data regarding the flow properties of the fracturing fluid during the fracturing process and analysing the acoustic data with the flow data to determine a fracture characteristic. The fracture characteristic may be the amount of proppant delivered to at least one of a plurality of a fracture sites.

The invention also relates to a system for fracture characterisation, said system comprising: a fibre optic interrogator adapted to provide distributed acoustic sensing on an optic fibre arranged along the path of a bore hole; a sampler arranged to sample a plurality of channels output from said interrogator to provide acoustic data from a plurality of portions of said fibre at each of a plurality of times; a flow monitor adapted to monitor the flow properties of fracture fluid into well bore to be fractured and a data analyser adapted to process said sampled acoustic data with said flow data to determine at least one fracture characteristic.

The system of the present invention offers all of the same advantageous and can be implemented with all of the embodiments of the invention as described above.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention extends to methods, apparatus and/or use substantially as herein described with reference to the accompanying drawings.

Any feature in one aspect of the invention may be applied to other aspects of the invention, in any appropriate combination. In particular, method aspects may be applied to apparatus aspects, and vice versa.

Furthermore, features implemented in hardware may generally be implemented in software, and vice versa. Any reference to software and hardware features herein should be construed accordingly.

DESCRIPTION OF THE DRAWINGS

Preferred features of the present invention will now be described, purely by way of example, with reference to the accompanying drawings, in which.

DESCRIPTION OF THE INVENTION

In typical well formation for many oil and gas wells, a well bore is drilled and then a metal casing is forced down the borehole with sections of casing being joined to one another. Once the casing is in place the outside of the casing is filled with cement, at least to a certain well depth, to effectively the seal the casing from the surrounding rock and ensure that the only flow path is through the casing. Once the cement has cured the well may be perforated by lowering a 'gun' which comprises one or more shaped charges to a desired depth of the well bore. The gun may be oriented, for example be using a magnetic anomaly detector to position the gun with respect to a feature on the casing, and the shaped charge(s) detonated to perforate the casing, cement backing and the rock formation.

After perforation, the perforation charge string is removed and a mixture of fluid, such as water, and a solid proppant, such as sand, is forced down the well at high pressure to fracture the rock along weak stress lines and to create and enlarge permeable paths for gas or other fluid to enter the well. Once a set of fractures at one level has been created it may be wished to create another set of fractures at another level. A blanking plug is therefore inserted down the well to block the section of well just perforated. The perforating and fracturing process is then repeated at a different level.

This process is repeated until all necessary fractures have been completed.

The hydraulic fracturing step is a key step in such well production as it is the fracturing that determines the ultimate flow of product from the rock formation into the well. It is therefore very important that the fracturing process is performed satisfactorily.

Figure 1:
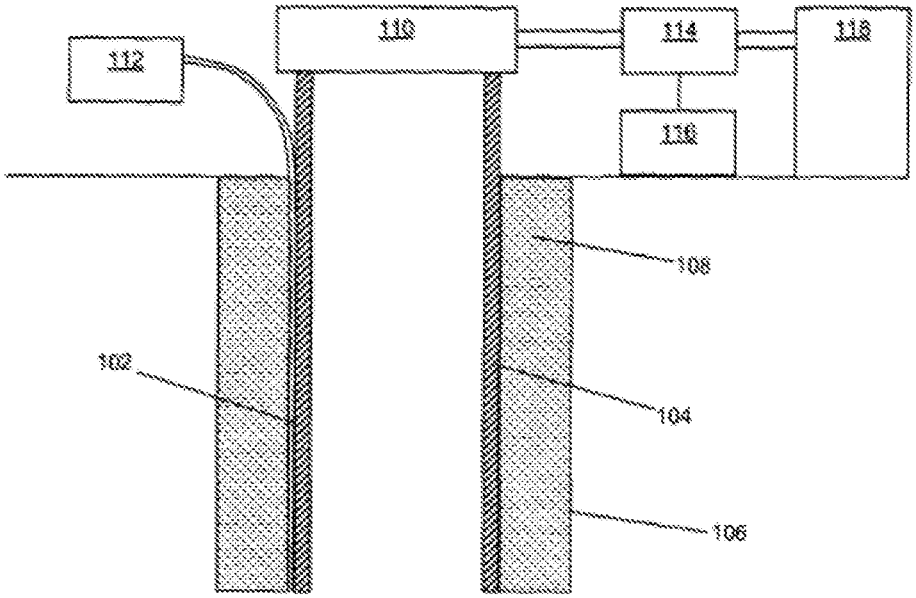
FIG. 1 illustrates the top of well bore having a distributed acoustic sensor during a hydraulic fracturing process.

FIG. 1 illustrates the top of a well bore during a hydraulic fracturing process. The metallic production casing 104 is illustrated in a bore hole 106, with the space between the outer wall of the casing and the hole being back filled with cement 108.

The top of the casing 104 is covered by a cap 110 through which fracturing fluid and proppant can flow. The fluid may be forced into the middle of the casing 104 by pump 114 which draws the fluid from reservoir 118. A flow monitor 116 monitors various properties of the fluid flow such as flow rate, fluid pressure and proppant concentration.

In conventional well formation the only data available to the operators of the fracturing process is the flow data and the 'feel' of the process. Thus the operators have no reliable way of determining what is happening down the well.

FIG. 1 shows an embodiment in which distributed acoustic sensing (DAS) is used to provide information about what is actually happening downwell during the fracturing process. A fibre optic cable 102 is included along the path of the well bore for the DAS sensor. In the example shown in FIG. 1 the fibre passes through the cement back fill, and is in fact clamped to the exterior of the metallic casing. It has been found that an optical fibre which is constrained, for instance in this instance by passing through the cement back fill, exhibits a different acoustic response to certain events to a fibre which is unconstrained. An optical fibre which is constrained may give a better response than one which is unconstrained and thus it may be beneficial to ensure that the fibre in constrained by the cement. The difference in response between and constrained and unconstrained fibre may also be used as an indicator of damage to the cement which can be advantageous will be described later.

The fibre protrudes from the well head and is connected to interrogator/processor unit 112. In operation the interrogator 112 launches interrogating electromagnetic radiation, which may for example comprise a series of optical pulses having a selected frequency pattern, into the sensing fibre. The optical pulses may have a frequency pattern as described in GB patent publication GB 2,442,745 the contents of which are hereby incorporated by reference thereto. As described in GB 2,442,745 the phenomenon of Rayleigh backscattering results in some fraction of the light input into the fibre being reflected back to the interrogator, where it is detected to provide an output signal which is representative of acoustic disturbances in the vicinity of the fibre. The interrogator may therefore conveniently comprises at least one laser and at least one optical modulator for producing a plurality of optical pulse separated by a known optical frequency difference. The interrogator also comprises at least one photodetector arranged to detect radiation which is backscattered from the intrinsic scattering sites within the fibre 102.

The signal from the photodetector is processed by a signal processor which may or may not form part of the interrogator 112. The signal processor conveniently demodulates the returned signal based on the frequency difference between the optical pulses such as described in GB 2,442,745. The signal processor may also apply a phase unwrap algorithm as described in GB 2,442,745.

The form of the optical input and the method of detection allow a single continuous fibre to be spatially resolved into discrete longitudinal sensing portions. That is, the acoustic signal sensed at one sensing portion can be provided substantially independently of the sensed signal at an adjacent portion.

The sensing fibre 102 can be many kilometres in length and typically fibre would be provided down the whole depth of the well bore. The sensing fibre may be a standard, unmodified single mode optic fibre such as is routinely used in telecommunications applications, possibly in a suitable protective cover.

The fibre optic 102 may therefore be interrogated by interrogator 112 to provide a plurality of discrete sensing portions of the fibre. In the method of the present invention the sensing portions in the vicinity of the hydraulic fracturing site may be monitored and processed together with flow date from flow monitor 116 to determine fracturing characteristics.

FIG. 2 illustrates a lower section of the well bore with three perforation sites, 201, 202 and 203 and a blanking plug 204 isolating a previously fractured deeper section of the well. FIG. 2 shows all of the perforation sites on the same side of the well although of course in practice there may be perforations in more than one direction at a particular depth of the well. Further, although FIG. 2 illustrates a vertical section of well it will be appreciated that the present invention applies equally to horizontal well bores or horizontal sections.

It will of course be appreciated that when orientating the perforation charges for firing care should be taken not to fire the perforation charge at the optic fibre 102. This may be achieved by ensuring that the well casing in the vicinity of the fibre and/or the fibre packaging provides a relatively strong magnetic signature and using a magnetic anomaly detector on the perforation charge string to determine and avoid aiming the charges at the relative location of said signature.

Figure 2A:
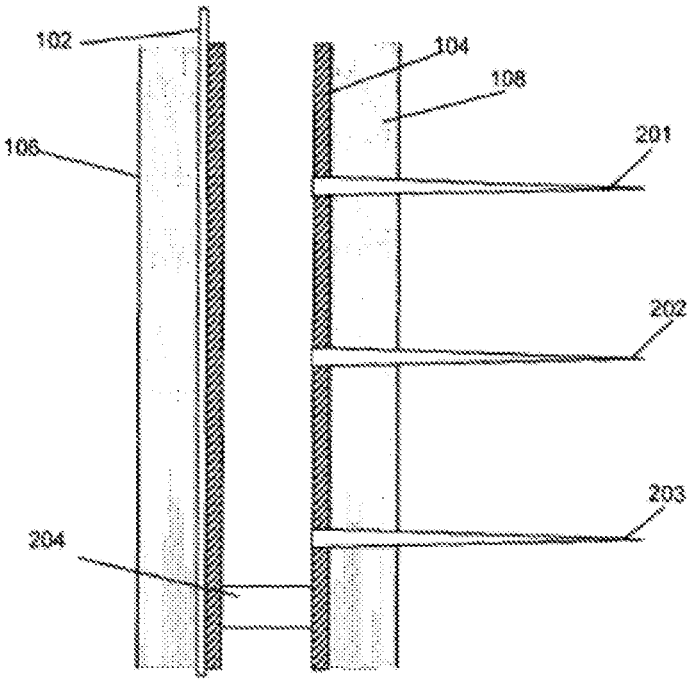
FIG. 2*a* illustrates the a plurality of fracturing sites and FIG. 2*b* illustrates uneven flow to the fracturing sites.
Figure 2B:
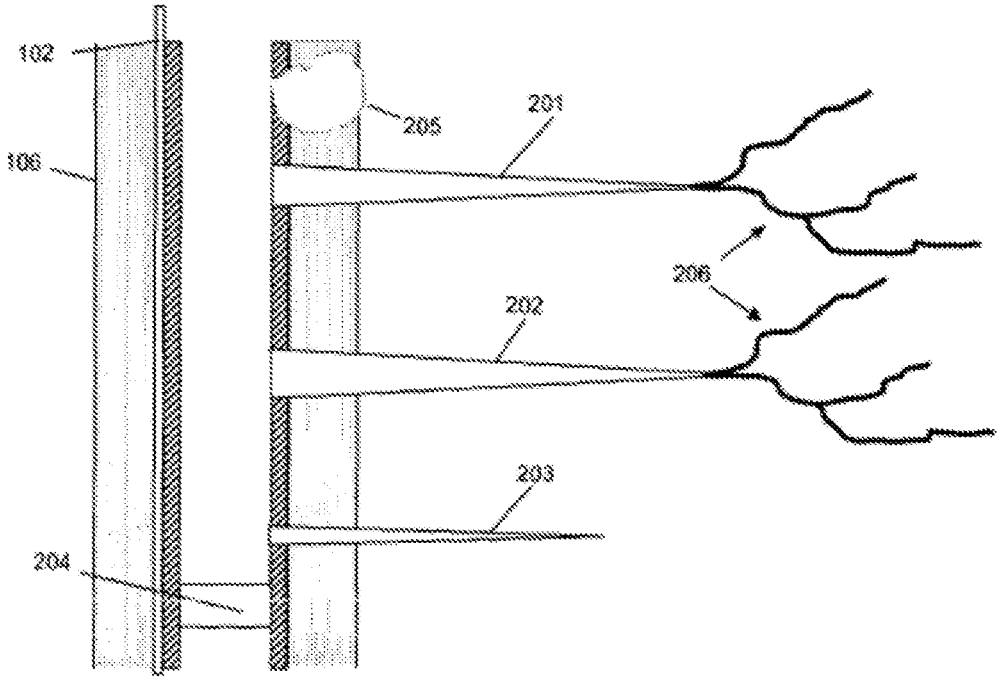

Once the perforations have been made the fluid and proppant is flowed into the well to cause fracturing 206, as illustrated in FIG. 2*b*. The acoustic responses of the acoustic channels of fibre in the vicinity of the perforations are monitored. Flow of the high pressure fluid containing a solid particulate through the casing 104 creates lots of acoustic disturbance and all channels of the fibre that correspond to sections of the well bore in which flow is occurring will generate show an acoustic response. However it has been found that the acoustic channels in the vicinity of the perforation sites exhibit an acoustic response which is related to the flow of fracture fluid into the perforation site and the fracturing occurring. It has also been found that this response can be seen most markedly by looking at discrete frequency bands of the acoustic disturbances.

Figure 3A:
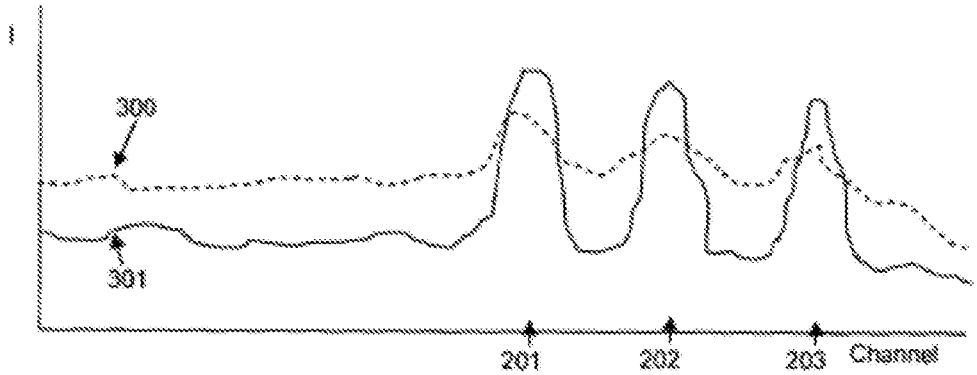
FIGS. 3*a* and 3*b* illustrates the acoustic energy in the acoustic data from the channels in the vicinity of the perforation sites.

FIG. 3*a* illustrates the acoustic intensity that may be detected by a plurality of acoustic channels of the fibre in the vicinity of the perforation sites illustrated in FIG. 2*a* during the hydraulic fracturing process. Arrows 201, 202, and 203 illustrate the location of the perforation sites. Dashed curve 300 illustrates a normalised average intensity of all acoustic disturbances detected by the fibre. It can be seen that there is a general level of disturbance of acoustic sections of the fibre throughout the section shown, although the intensity drops for channels which represent sections of the well bore below blanking plug 204. In the vicinity of the perforation sites 201, 202 and 203 there are slight increases in acoustic intensity. Solid curve 301 however shows the normalised acoustic intensity for disturbances within a spectral band, i.e. disturbances that have a frequency within a particular range. It can be seen that the intensity difference in signal in the vicinity of the perforation sites is much more pronounced. The exact frequency band of interest may vary depending on the parameters of the well bore, the casing, the surrounding rock formation and the flow parameters of the fracture fluid, i.e. pressure, flow rate, proppant type and proportion etc. The signal returns may therefore be processed in a number of different frequency bands and displayed to an operator, either simultaneously (e.g. in different graphs or overlaid curves of different colours) or sequentially or as selected by the user. The data may also be processed to automatically detect the spectral band that provided the greatest difference between the intensity at channels in the vicinity of the perforation site and channels at other sections of the well.

Curve 301 illustrates that the acoustic response at each of the perforation sites is approximately the same. This can indicate that fracture fluid is being forced into all of the perforation sites equally and they all have similar characteristics. Thus the relative flow rates of the fracture fluid and proppant to the various fracture sites 201, 202, 203 are generally equal.

In some instances however some fracture sites may be active than other sites in that some fracture sites may consume more proppant than other sites. FIG. 2*b* represents the situation which may develop wherein perforation sites 201 and 202 have been enlarged by the fracture fluid being forced into them and that the rock formation is being fractured at fracture points 206. However no significant fracturing is occurring at perforation site 203. This may occur for a variety of reasons but once such a situation develops, most of the fracture fluid may flow into perforation sites 201 and 202, with the result that site 203 remains dormant. If this situation continues then eventually, when the fracturing process is complete, only perforation sites 201 and 202 will provide significant paths for oil or gas to flow to the well bore and thus this section of well will be less efficient than intended.

Figure 3B:
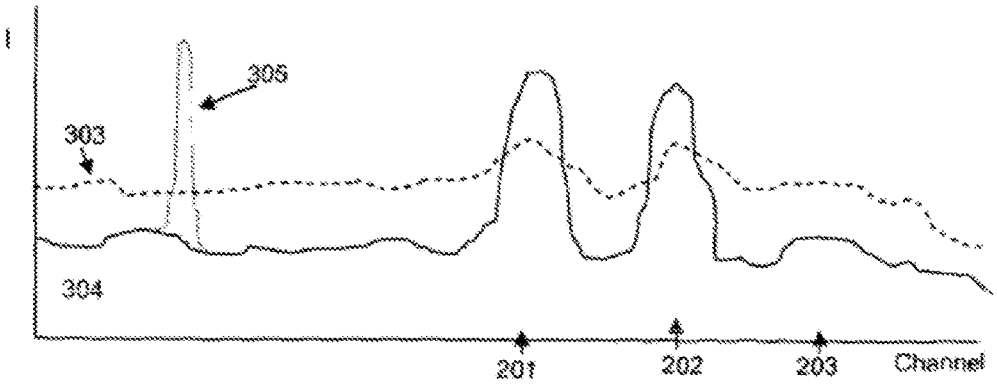

FIG. 3*b* illustrates the acoustic response that may be generated from the situation shown in FIG. 2*b*. Dashed curve 303 shows the total intensity, i.e. acoustic energy, for each channel across all frequencies. Again this curve does show the general trend but it is much clearer looking at solid curve 304 which again shows the acoustic response from a narrowed spectral range. Curve 304 shows that whilst there is a large signal intensity at perforation sites 201 and 202 due to the fracture fluid flowing into the perforation site and causing fracturing, there is in this instance, no such response in the vicinity of perforation site 203. This indicates that the extent of any fracturing via perforation site 203 is significantly limited.

The acoustic data can thus give a general indication of what is actually happening downwell but in the method of the present invention this data can be correlated with the flow data acquired by flow monitor 116 to determine fracture characteristics.

Figures 4A, 4B, 4C:
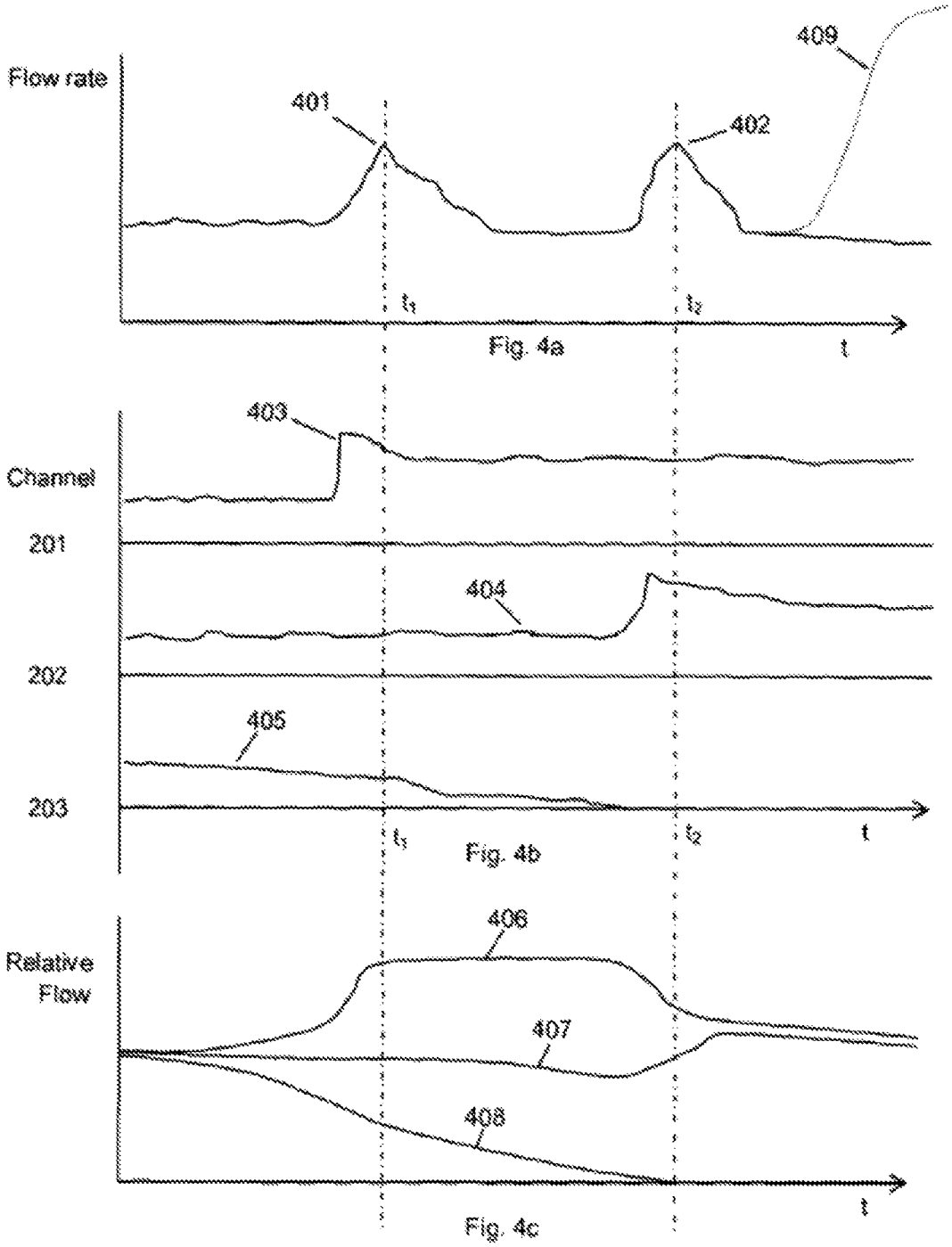
FIG. 4*a* illustrates variations in flow rate of the fracture fluid over time.
FIG. 4*b* illustrates variations in the acoustic energy of the various acoustic channels and FIG. 4*c* illustrates the relative flow rates to each of the fracture sites.

In one arrangement the comparison of the acoustic data and the flow data may help identify what is actually going on in the well. FIG. 4*a* illustrates flow rate data indicating the flow rate of fracture fluid, and hence proppant (for a constant concentration of proppant in the fluid—if the concentration of proppant in the fluid changes over time this can be separately monitored/recorded). FIG. 4*a* illustrates that the flow rate of fluid into the well is reasonably constant until time t1 where there is a sudden jump in flow rate for a short period of time. Again a time t2 there is a sudden jump in flow rate.

This could be taken to indicate that fracturing occurred around times t1 and t2 thus opening new flows paths for the fluid for a short period of time. On its own this data may indicate that fracturing is occurring but it contains no information about whether the fracture sites are developing equally or not.

FIG. 4*b* illustrates the evolution over the same time period of the acoustic intensity of the DAS sensor corresponding to the perforation sites 201; 202 and 203 (averaged over a short period of time). It can be seen that at a time just before t1 there was a sudden increase in intensity of the acoustic signals 403 from the channel corresponding to perforation site 201. As this correlates with the sudden jump in flow rate it can be seen that the data points to significant fracturing at time t1 at site 201. Similarly the rise in acoustic intensity at time t2 in the data from channel corresponding to site 202 indicates significant fracturing at this point.

The data in FIGS. 4*a* and 4*b* has been simplified for ease of explanation but it will be clear that by correlating acoustic events with changes in the flow conditions the location and extent of fracturing can be determined.

The data can also be used to determine a fault condition, such as proppant wash out. This occurs when a section of the casing and cement surround fails, such as shown by cavity 205 in FIG. 2*b*, and the fluid an proppant has an alternative path to escape. In such an event the flow rate 409 of the proppant may increase. However as the wash out may occur at a different part of the well bore the acoustic signals from the perforation sites may not be significantly different. However the wash-out would be likely to cause a new acoustic signal 305 at a different part of the well bore as illustrated in FIG. 3*b*.

The amount of proppant delivered to each fracture site during the fracturing process can also be determined. It will be apparent that, for a constant concentration of proppant in the fluid, the flow rate of the fluid shown in FIG. 4*a* also illustrates the flow rate of proppant.

From FIGS. 3*a* and 3*b* it will be apparent that the relative proportion of the flow to each of the fracture sites can be determined. FIG. 4*b* can be seen as indicating the relative acoustic energy in a spectral band of interest overtime. By analysing the relative intensities of the acoustic channels of interest and the flow rate of the fluid (and any changes in prop pant concentration) over time it is possible to determine the relative flow of proppant to each of the fracture sites over time as shown in FIG. 4*c*. By integrating under the curve for each site the total proportion of proppant delivered to that fracture site can be determined. Knowing the total amount of proppant delivered it is thus possible to determine how much proppant was delivered to each fracture site.

Determining the absolute amount of proppant delivered to each fracture site may be used as part of a control process, for instance to stop when a certain limit has been reached. A measure of the absolute amount of proppant delivered may also be used as part of a subsequent analysis of the well formation in order to improve knowledge of the fracturing process. It will be clear that the optical fibre, when deployed, will remain in the well during operation. The DAS sensing can also provide useful sensing capabilities relating to the subsequent operation of the well. For instance the monitoring of fluid such as oil and gas flowing into a well from neighbouring rock formations may be performed. Detecting and quantifying the areas of inflow within a well is possible by analysing a 2D 'waterfall' energy map. The relative inflow from the various perforation sites can therefore be compared with the fracturing data to determine useful information about the optimum amount of proppant required for particular rock formations.

It will be noted that the configuration of the channels can also be adjusted, and different channel settings can be used for different monitoring operations. The channel settings can also be adaptively controlled in response to monitored data, for example if a significant fracture occurs at a certain depth, it may be desirable to monitor that particular depth with greater resolution for a period of time, before reverting to the original channel configuration.

It will be understood that the present invention has been described above purely by way of example, and modification of detail can be made within the scope of the invention.

Each feature disclosed in the description, and (where appropriate) the claims and drawings may be provided independently or in any appropriate combination.

The invention claimed is:

1. A method of fracture characterisation of a downwell hydraulic fracturing process comprising:

interrogating an optic fibre arranged down the path of a well bore to provide a distributed acoustic sensor;

monitoring flow properties of fracturing fluid as it flows into the well bore; and processing acoustic data from the distributed acoustic sensor together with flow data from monitoring the flow properties to provide an indication of at least one fracture characteristic, wherein providing said indication of at least one fracture characteristic comprises determining an amount of fracturing fluid and/or proppant supplied to each fracture site;

wherein the acoustic data for a sensing portion at a single location of the fibre in the vicinity of a fracturing site is divided into two or more spectral bands and an average intensity determined for each of said spectral bands, and analyzing the acoustic data by comparing intensity levels of acoustic disturbances in the vicinity of each of a number of different fracture sites to determine the relative flow rates of the fracture fluid and/or proppant to individual fracture sites.

2. A method as claimed in claim 1 wherein interrogating the optical fibre comprises: launching a series of optical pulses into said optic fibre and detecting radiation Rayleigh backscattered from within the optic fibre; and processing the detected Rayleigh backscattered radiation to provide a plurality of discrete longitudinal sensing portions of the optic fibre.

3. A method as claimed in claim 1 wherein the flow data is correlated with the acoustic data.

4. A method as claimed in claim 3 comprising correlating any acoustic disturbances, or changes in acoustic signals in the acoustic data with a change in flow properties in the flow data.

5. A method as claimed in claim 1 further comprising: monitoring acoustic disturbances in the optical fibre generated during perforation of the well bore prior to the downwell hydraulic fracturing process; and determining which portions of the optical fibre that correspond to fracture sites.

6. A method as claimed in claim 1 wherein the flow data comprises at least one of flow rate, flow pressure, proppant concentration or proppant flow rate over time.

7. A method as claimed in claim 1 wherein the determined amount of fracture fluid and/or proppant supplied to each fracture site is used in controlling the hydraulic fracturing process.

8. A method as claimed in claim 7 wherein the determined amount of fracture fluid and/or proppant delivered to each fracture site is used as a measure of the degree or extent of fracturing at such fracture site.

9. A method as claimed in claim 7 comprising monitoring a cumulative amount of proppant delivered to each fracture site and stopping the hydraulic fracturing process once a predetermined amount of proppant has been delivered to a fracture site.

10. A method as claimed in claim 1 comprising the step of correlating the fracturing characteristic with data on subsequent production of oil or gas from the well.

11. A method as claimed in claim 1 comprising the step of analysing the acoustic data from a plurality of spectral bands to identify a spectral band of interest.

12. A method as claimed in claim 11 wherein said step of analysing the acoustic data comprises determining a spectral band in which an intensity of acoustic disturbances in that spectral band in sensing portions of fibre corresponding to the fracture sites are significantly higher than the intensity in other nearby sensing portions.

13. A method according to claim 1 wherein an average intensity of acoustic energy in each relevant sensing portion of fibre is additionally used to determine the relative flow rates to each fracture site.

14. A system for fracture characterisation, said system comprising: a fibre optic interrogator adapted to provide distributed acoustic sensing on an optic fibre arranged along the path of a well bore; a sampler arranged to sample a plurality of channels output from said interrogator to provide acoustic data from a plurality of portions of said optic fibre at each of a plurality of times; a flow monitor adapted to monitor flow properties of fracture fluid into the well bore to be fractured and provide flow data and a data analyser adapted to process said sampled acoustic data with said flow data to determine at least one fracture characteristic, where said processing comprises determining the amount of fracturing fluid and/or proppant supplied to each fracture site wherein the acoustic data for a sensing portion at a single location of the fibre in the vicinity of a fracturing site is divided into one two or more spectral bands and an average intensity determined for each of said spectral bands and analyzing the acoustic data by comparing intensity levels of acoustic disturbances in the vicinity of each of a number of different fracture sites to determine the relative flow rates of the fracture fluid and/or proppant to individual fracture sites.

15. A system as claimed in claim 14 further comprising a flow controller for automatically controlling flow of the fracture fluid based on said determined amount of fracturing fluid and/or proppant supplied to each fracture site.

16. A system as claimed in claim 14 further comprising a flow controller for automatically stopping flow of the fracture fluid when the determined amount of fracturing fluid and/or proppant supplied to a fracture site reached a predefined amount.

17. A method comprising:

accessing a first data set corresponding to acoustic data obtained by interrogating an optic fibre arranged down the path of a well bore to provide a distributed acoustic sensor during a downwell hydraulic fracturing process;

accessing a second data set corresponding to flow data obtained by monitoring flow properties of fracturing fluid as it flows into the well bore during the downwell hydraulic fracturing process; and processing the acoustic data together with the flow data to determine an amount of fracturing fluid and/or proppant supplied to each fracture site by dividing the acoustic data for a sensing portion at a single location of the fibre in the vicinity of a fracturing site into two or more spectral bands and an average intensity determined for each of said spectral bands and analyzing the acoustic data by comparing intensity levels of acoustic disturbances in the vicinity of each of a number of different fracture sites to determine the relative flow rates of the fracture fluid and/or proppant to individual fracture sites.

* * * * *